US011433677B2

(12) United States Patent
Omura et al.

(10) Patent No.: US 11,433,677 B2
(45) Date of Patent: Sep. 6, 2022

(54) LIQUID STORAGE DEVICE AND LIQUID FILLING METHOD

(71) Applicant: CANON KABUSHIKI KAISHA, Tokyo (JP)

(72) Inventors: Atsushi Omura, Kanagawa (JP); Hiroki Tajima, Kanagawa (JP); Keiichiro Tsukuda, Kanagawa (JP); Kenji Yabe, Kanagawa (JP); Yuji Tamaru, Tokyo (JP); Naoko Shimizu, Kanagawa (JP); Sayaka Seki, Kanagawa (JP); Yosuke Takagi, Kanagawa (JP); Shimpei Yoshikawa, Kanagawa (JP); Ryo Sato, Tokyo (JP); Kyosuke Toda, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/103,307

(22) Filed: Nov. 24, 2020

(65) Prior Publication Data

US 2021/0162766 A1 Jun. 3, 2021

(30) Foreign Application Priority Data

Dec. 3, 2019 (JP) ..... JP2019-218692

(51) Int. Cl.
*B41J 2/175* (2006.01)

(52) U.S. Cl.
CPC ..... *B41J 2/17509* (2013.01); *B41J 2/17523* (2013.01); *B41J 2/17596* (2013.01)

(58) Field of Classification Search
CPC .... B41J 2/175; B41J 2/17506; B41J 2/17509; B41J 2/17513; B41J 2/17523; B41J 2/17563; B41J 2/17596; B41J 2002/17579
See application file for complete search history.

(56) References Cited

U.S. PATENT DOCUMENTS

| | | | | |
|---|---|---|---|---|
| 5,430,471 | A | 7/1995 | Nakajima et al. | 347/87 |
| 5,479,968 | A | 1/1996 | Sanchez et al. | 141/110 |
| 5,504,511 | A | 4/1996 | Nakajima et al. | 347/86 |
| 5,583,549 | A | 12/1996 | Ujita et al. | 347/86 |
| 5,589,862 | A | 12/1996 | Ujita et al. | 347/87 |

(Continued)

FOREIGN PATENT DOCUMENTS

| | | |
|---|---|---|
| CN | 101032889 | 9/2007 |
| EP | 0703083 | 3/1996 |

(Continued)

OTHER PUBLICATIONS

Office Action dated Jul. 5, 2022 in counterpart Chinese Application No. 202011369938.2, together with English translation thereof.

*Primary Examiner* — Anh T Vo
(74) *Attorney, Agent, or Firm* — Venable LLP

(57) ABSTRACT

A liquid filling method of filling a liquid storage device including a first tank that stores a liquid to be supplied to an ejection head ejecting the liquid and a second tank that stores the liquid to be supplied to the first tank through a connection port provided in the first tank with the liquid, the method including: injecting the liquid from a liquid storage container into the first tank through a first liquid introduction port provided in the first tank, in a state where a second liquid introduction port provided in the second tank is closed.

11 Claims, 5 Drawing Sheets

(56) References Cited

U.S. PATENT DOCUMENTS

| | | | | |
|---|---|---|---|---|
| 5,604,523 | A | 2/1997 | Tsukuda et al. | 347/86 |
| 5,608,437 | A | 3/1997 | Iwata et al. | 347/86 |
| 5,619,237 | A | 4/1997 | Inoue et al. | 347/86 |
| 5,663,754 | A | 9/1997 | Lorenze et al. | 347/87 |
| 5,701,995 | A | 12/1997 | Higuma et al. | 206/205 |
| 5,742,309 | A | 4/1998 | Tajima et al. | 347/86 |
| 5,781,213 | A | 7/1998 | Ujita et al. | 347/86 |
| 5,784,088 | A | 7/1998 | Ujita et al. | 347/86 |
| 5,900,889 | A | 5/1999 | Tsukuda | 347/23 |
| 5,903,294 | A | 5/1999 | Abe et al. | 347/87 |
| 5,988,804 | A | 11/1999 | Kotaki et al. | 347/87 |
| 6,045,218 | A | 4/2000 | Tajima et al. | 347/86 |
| 6,058,984 | A * | 5/2000 | Sato | B41J 2/17506 141/13 |
| 6,102,533 | A | 8/2000 | Nozawa et al. | 347/86 |
| 6,152,555 | A | 11/2000 | Nozawa et al. | 347/49 |
| 6,170,939 | B1 | 1/2001 | Ujita et al. | 347/86 |
| 6,179,415 | B1 | 1/2001 | Okazaki et al. | 347/86 |
| 6,179,416 | B1 | 1/2001 | Ikeda et al. | 347/86 |
| 6,234,615 | B1 | 5/2001 | Tsukuda | 347/85 |
| 6,250,752 | B1 | 6/2001 | Tajima et al. | 347/92 |
| 6,264,315 | B1 | 7/2001 | Nozawa et al. | 347/86 |
| 6,286,944 | B1 | 9/2001 | Shimizu et al. | 347/86 |
| 6,336,709 | B1 | 1/2002 | Inoue et al. | 347/49 |
| 6,338,546 | B1 | 1/2002 | Kotaki et al. | 347/49 |
| 6,361,158 | B1 | 3/2002 | Inoue et al. | 347/86 |
| 6,431,681 | B2 | 8/2002 | Hatasa et al. | 347/19 |
| 6,454,399 | B2 | 9/2002 | Ujita et al. | 347/86 |
| 6,474,796 | B1 | 11/2002 | Ishinaga | 347/85 |
| 6,565,199 | B2 | 5/2003 | Ujita et al. | 347/86 |
| 6,631,982 | B2 | 10/2003 | Sasaki et al. | 347/85 |
| 6,679,574 | B2 * | 1/2004 | Sato | B41J 2/17566 347/7 |
| 6,783,220 | B2 | 8/2004 | Ujita et al. | 347/87 |
| 6,805,437 | B2 | 10/2004 | Yamanaka et al. | 347/92 |
| 6,815,381 | B1 | 11/2004 | Yamamoto et al. | 442/187 |
| 6,851,795 | B2 | 2/2005 | Watanabe et al. | 347/50 |
| 6,945,643 | B2 | 9/2005 | Tajima et al. | 347/87 |
| 7,044,588 | B2 | 5/2006 | Tajima et al. | 347/85 |
| 7,293,865 | B2 | 11/2007 | Tsukuda et al. | 347/86 |
| 7,384,129 | B2 | 6/2008 | Nagata et al. | 347/43 |
| 7,401,909 | B2 | 7/2008 | Inoue et al. | 347/86 |
| 7,407,274 | B2 | 8/2008 | Inoue et al. | 347/86 |
| 7,407,275 | B2 | 8/2008 | Inoue et al. | 347/86 |
| 7,766,466 | B2 | 8/2010 | Taniguchi et al. | 347/85 |
| 7,914,137 | B2 | 3/2011 | Inoue et al. | 347/86 |
| 8,025,382 | B2 | 9/2011 | Tajima | 347/87 |
| 8,425,022 | B2 | 4/2013 | Inoue et al. | 347/86 |
| 9,321,274 | B2 | 4/2016 | Takagi et al. | B41J 2/1752 |
| 9,597,884 | B2 | 3/2017 | Nanjo et al. | B41J 2/17526 |
| 9,738,081 | B2 | 8/2017 | Kimura et al. | B41J 2/17533 |
| 9,821,562 | B2 | 11/2017 | Nanjo et al. | B41J 2/17523 |
| 9,840,082 | B2 | 12/2017 | Nanjo et al. | B41J 2/17513 |
| 9,962,945 | B2 | 5/2018 | Takaoka et al. | B41J 2/17523 |
| 9,981,477 | B2 | 5/2018 | Fukuchi et al. | B41J 2/17553 |
| 9,981,478 | B2 | 5/2018 | Ikebe et al. | B41J 29/02 |
| 10,118,396 | B2 | 11/2018 | Kimura et al. | B41J 2/17596 |
| 10,207,511 | B2 | 2/2019 | Nanjo et al. | B41J 2/175 |
| 2004/0017448 | A1 * | 1/2004 | Murakami | B41J 2/17509 347/86 |
| 2005/0099449 | A1 | 5/2005 | Frasure et al. | 347/20 |
| 2006/0290751 | A1 | 12/2006 | Taniguchi et al. | 347/85 |
| 2007/0186984 | A1 | 8/2007 | Kimura | 137/588 |
| 2009/0064501 | A1 | 3/2009 | Kimura et al. | 29/890.1 |
| 2020/0207103 | A1 | 7/2020 | Tamaru et al. | B41J 2/195 |
| 2020/0290362 | A1 | 9/2020 | Tajima et al. | B41J 2/17596 |

FOREIGN PATENT DOCUMENTS

| | | | |
|---|---|---|---|
| JP | 2007-001209 | 1/2007 | |
| JP | 103753964 * | 4/2014 | B41J 2/17506 |

* cited by examiner

LIQUID STORAGE DEVICE AND LIQUID FILLING METHOD

BACKGROUND OF THE INVENTION

Field of the Invention

The present invention relates to a liquid storage device and a liquid filling method.

Description of the Related Art

An ink jet recording apparatus having an ink supply tank mounted on a main body is used as an apparatus in which an ejection head ejects a liquid from an ejection orifice and the liquid is recorded on a recording medium. The ink jet recording apparatus supplies ink to a head tank mounted on the ejection head from the ink supply tank using a tube and ejects the ink from the ejection head. A filter is provided to prevent the ink ejection from the ejection head from being blocked by foreign matter entering from an outside of the ejection head. This filter removes the foreign matter in the supplied ink and is provided for each color in a flow path between the head tank and the ejection head.

When air bubbles dissolved in the liquid (ink), or separated from the head tank or a member forming the ejection head, or entered from the tube connecting the supply tank to the head tank are accumulated in the head tank, air bubbles reduce an effective area of the filter. Therefore, a liquid flow resistance (pressure loss) occurs in the filter and a liquid ejection failure occurs. Japanese Patent Application Laid-Open No. 2007-001209 discloses a technique in which the inside of the head tank is depressurized by a negative pressure generating device and the air in the head tank is sucked by using a gas-liquid separation member.

However, in the suction using the gas-liquid separation member, since it is necessary to provide the ink jet recording apparatus with a mechanism such as a negative pressure generating device in advance, there is a problem that the cost of the ink jet recording apparatus increases.

SUMMARY OF THE INVENTION

According to the present invention, there is provided a liquid filling method of filling a liquid storage device including a first tank that stores a liquid to be supplied to an ejection head ejecting the liquid and a second tank that stores the liquid to be supplied to the first tank through a connection port provided in the first tank with the liquid, the method including: injecting the liquid from a liquid storage container into the first tank through a first liquid introduction port provided in the first tank, in a state where a second liquid introduction port provided in the second tank is closed.

Further features of the present invention will become apparent from the following description of exemplary embodiments with reference to the attached drawings.

DESCRIPTION OF THE EMBODIMENTS

Figure 1A:
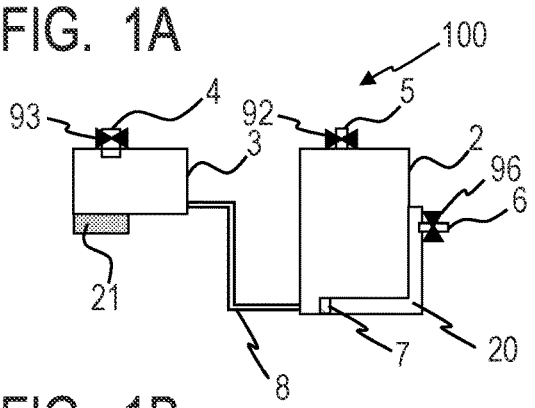
FIGS. 1A, 1B, 1C, 1D, 1E, 1F, 1G and 1H are diagrams describing steps of a first embodiment of filling a tank with a liquid before filling the liquid.

An object of the present invention is to provide a liquid storage device and a liquid filling method capable of reducing the cost of an ink jet recording apparatus by eliminating the need for a negative pressure generating device in view of the above-described problems.

According to the present invention, it is possible to provide the liquid storage device and the liquid filling method capable of reducing the cost of the ink jet recording apparatus by eliminating the need for the negative pressure generating device.

Hereinafter, the liquid storage device and the liquid filling method according to the embodiment of the present invention will be described with reference to the drawings. In each of the embodiments described below, the ink jet recording apparatus mounted with an ejection head that ejects ink, which is an example of a liquid, will be described using a specific configuration.

In addition, since the embodiment described below is an embodiment to which the present invention is applied, various technically favorable limitations are attached. However, the present invention is not limited to the embodiments and other specific methods in the present specification as long as the present invention is in accordance with the technical ideas. In the following description, the same number will be assigned to the configurations having the same function in the drawings and the description of the overlapping portion will be omitted.

(Recording Device)

Figure 5A:
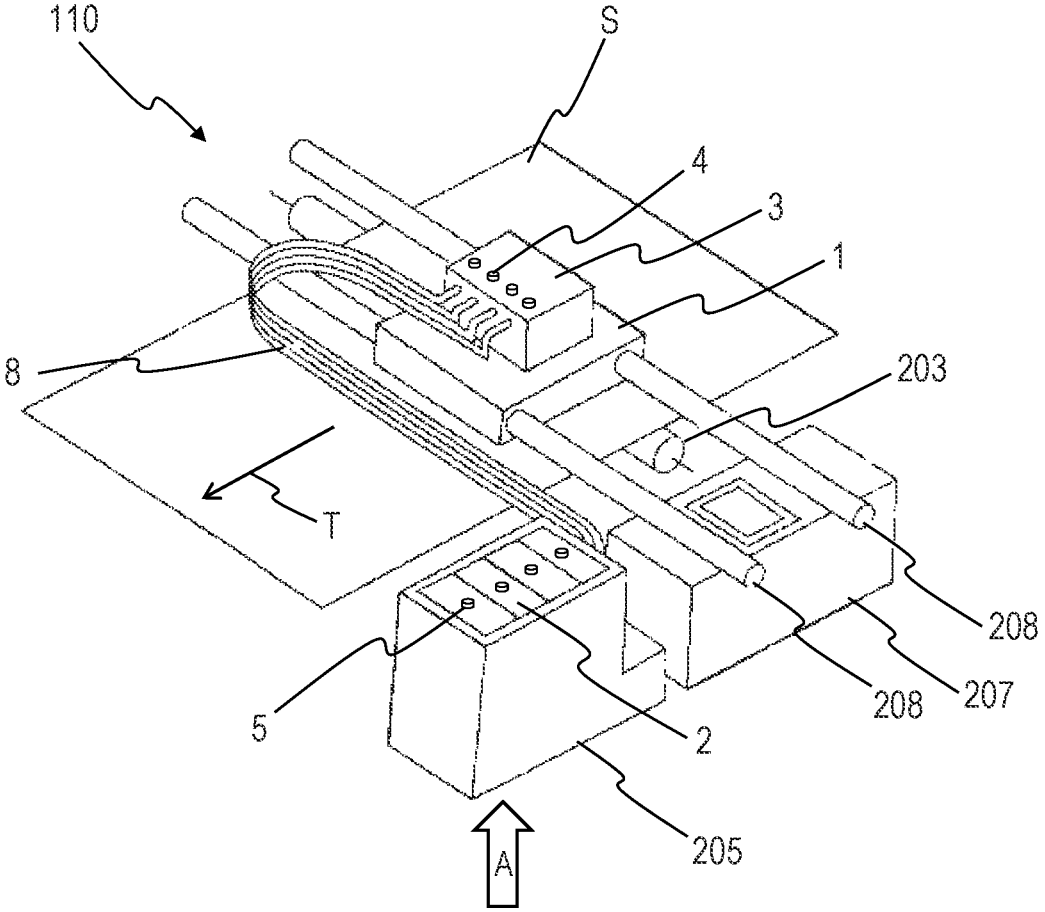
FIGS. 5A and 5B are perspective diagrams illustrating a main part of an ink jet recording apparatus.

The outline of the ink jet recording apparatus of the present invention will be described with reference to FIGS. 5A and 5B. As illustrated in FIG. 5A, an ink jet recording apparatus 110 repeats a reciprocating movement (main scanning) of an ejection head (recording head) 1 and conveyance (sub-scanning) of a recording sheet S such as a general recording paper, a special paper and an OHP film at predetermined pitch intervals. The ink jet recording apparatus 110 is a serial type ink jet printer that forms characters, symbols and images by selectively ejecting a liquid of ink as an example from the ejection head 1 while synchronizing with these movements and adhering the liquid to the recording sheet S.

In FIG. 5A, the ejection head 1 is slidably supported by two guide rails 208 and reciprocates along the guide rails 208 by a driving unit such as a motor (not illustrated). The recording sheet S faces a liquid ejection surface of the ejection head 1 by a conveyance roller 203 and is conveyed in a direction intersecting a moving direction of the ejection head 1 (for example, arrow T direction as an orthogonal direction) while maintaining a constant distance from the liquid ejection surface.

The ejection head 1 has a plurality of ejection orifice rows, each of which ejects a liquid having a different color. The ejection head 1 is mounted with a recording element portion 21 (FIGS. 1A to 1H) described later. A plurality of one of electric heat conversion elements (heaters) and piezo elements is arranged in the recording element portion 21 as ejection energy generating elements for ejecting the liquid. The ejection energy generating element ejects the liquid supplied through the liquid supply path (tube 8) from the ejection orifice. For example, in a case where the electric heat conversion element is used as the ejection energy generating element, the heater generates heat to foam the liquid and the foaming energy is used to eject the liquid from the ejection orifice.

A plurality of independent supply tanks 2 is detachably attached to a liquid supply unit 205 according to the color of the liquid ejected from the ejection head 1. The liquid supply unit 205 and a head tank 3 are connected to each other by a plurality of tubes 8 corresponding to the color of the liquid, respectively. By mounting the supply tank 2 on the liquid supply unit 205, it is possible to independently supply the liquid of each color stored in the supply tank 2 to each ejection orifice row of the ejection head 1. The head tank 3 temporarily stores the liquid supplied from the supply tank 2 to the ejection head 1. The head tank 3 has a first liquid introduction port 4 and the supply tank 2 has a second liquid introduction port 5. The first liquid introduction port 4 and the second liquid introduction port 5 are openings for filling the head tank 3 and the supply tank 2 with the liquid from the outside. A specific method for filling the head tank 3 and the supply tank 2 with the liquid will be described later.

A recovery unit 207 is disposed so as to face the liquid ejection surface of the ejection head 1 in a non-recording region which is a region within a reciprocating movement range of the head tank 3 and outside a passage range of the recording sheet S. FIG. 5A illustrates an example in which the liquid is supplied from four supply tanks 2 to one head tank 3.

Figure 5B:
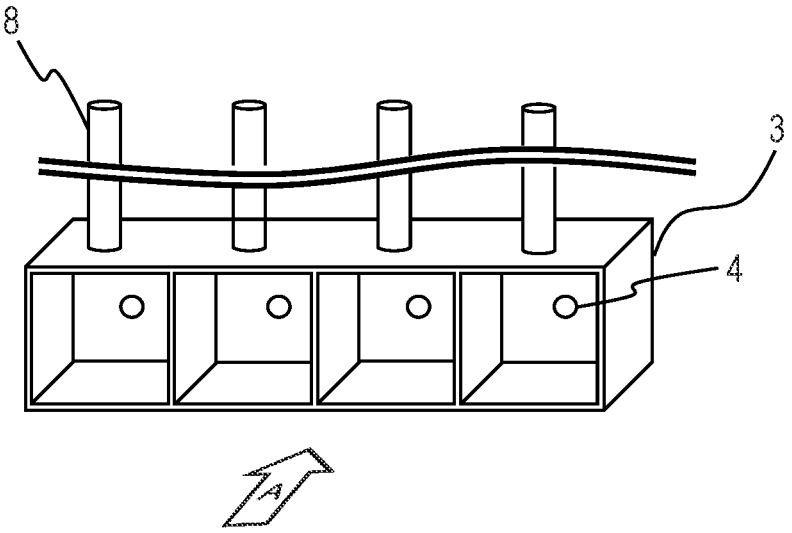

FIG. 5B is an enlarged view of the head tank 3 as viewed from the direction of arrow A in FIG. 5A (rear surface of the first liquid introduction port 4). As illustrated in FIG. 5B, the inside of the head tank 3 is partitioned according to the color of the liquid so that the liquid supplied from the supply tank 2 does not mix. The supply tank 2 and the head tank 3 can have any shape depending on the application and each liquid chamber of the supply tank 2 and the head tank 3 may be configured by any number.

(Liquid Storage Device)

Next, before describing the method of filling the liquid storage device with the liquid, the liquid storage device according to the present embodiment will be described with reference to FIGS. 1A to 1H and 2. As illustrated in FIGS. 1A and 2, a liquid storage device 100 is provided with the head tank 3 provided with the first liquid introduction port 4, the supply tank 2 provided with the second liquid introduction port 5, an atmospheric communication port 6 and a slit wall 7 and a liquid flow path 8. In addition, the liquid storage device 100 is provided with a control portion 104, a first detection portion 101, a second detection portion 102 and a third detection portion 103. The head tank 3 functions as a first tank and stores a liquid 12 supplied to the ejection head 1 (FIG. 5A) that ejects the liquid 12. The supply tank 2 functions as a second tank and stores the liquid 12 to be supplied to the head tank 3. A recording element portion 21 (FIG. 1A) is provided on a lower surface of the head tank 3. The liquid flow path (tube 8) connects the head tank 3 and the supply tank 2. The tube 8 is connected to the head tank 3 through a connection port provided in the head tank 3 and as the liquid is consumed by the ejection head 1, the liquid stored in the supply tank 2 passes through the tube 8 and is supplied to the head tank 3 through the connection port.

The first liquid introduction port 4 is provided on an upper surface of the head tank 3 and is a sealable opening for filling the inside of the head tank 3 with the liquid. A valve 93 that opens or closes the first liquid introduction port 4 and functions as a first valve is provided on the upper surface of the head tank 3. Switching between an open state and a closed state of the valve 93 is performed by a control signal 105 output from the control portion 104 of FIG. 2. The second liquid introduction port 5 is provided on the upper surface of the supply tank 2 and is a sealable opening for filling the inside of the supply tank 2 with the liquid. A valve 92 that opens or closes the second liquid introduction port 5 and functions as a second valve is provided on the upper surface of the supply tank 2. Switching between an open state and a closed state of the valve 92 is performed by a control signal 106 output from the control portion 104 of FIG. 2. By providing the liquid introduction port in each of the head tank 3 and the supply tank 2, the head tank 3 and the supply tank 2 can be individually filled with the liquid.

The atmospheric communication port 6 is provided on a side surface of the supply tank 2 and is an opening for communicating the inside of the supply tank 2 with the atmosphere through a slit wall 7 provided on a bottom surface of the supply tank 2. A valve 96 that allows the inside of the supply tank 2 and the atmosphere to be one of a non-communication state and a communication state and functions as a third valve is provided on the side surface of the supply tank 2. Switching between a closed state and an open state of the valve 96 is performed by a control signal 107 output from the control portion 104 of FIG. 2. As illustrated in FIG. 1A, the slit wall 7 forms a boundary surface between the inside of the supply tank 2 and the atmosphere. In addition, an air flow path 20 that functions as a buffer when a liquid leaks from the inside of the supply tank 2 is provided for a predetermined distance from the slit wall 7 to the atmospheric communication port 6. For example, in a case where the first liquid introduction port 4 and the second liquid introduction port 5 are in the closed state, the slit wall 7 is formed with a slit capable of holding the liquid inside the supply tank 2 by a meniscus force. The slit wall 7 has a characteristic that air passes through and the liquid does not pass through. By providing the slit wall 7 on the bottom surface of the supply tank 2, a hydraulic head differential pressure between the liquid inside the supply tank 2 and the liquid in the head tank 3 can be kept constant until the remaining amount of liquid inside the supply tank 2 reaches the position of the slit wall 7. It is not essential to provide the slit wall 7 and for example, a pressure control mechanism using an elastic body can be used instead.

The first detection portion 101 detects the filling amount of the liquid 12 in the first tank 3. The second detection portion 102 detects the filling amount of the liquid 12 in the second tank 2. The third detection portion 103 detects whether or not the liquid flow path 8 is filled with the liquid 12. Here, a method of detecting the filling amount of the liquid 12 in each tank may be performed by using a filling amount detection material 13 as an example of a detection material such as an electrode pin and an electrode pad described in another embodiment (FIGS. 4A to 4C) described later. The filling state of the liquid 12 detected by the first to third detection portions 101 to 103 is notified to the control portion 104. The control portion 104 controls the opening and closing of the valves 92, 93 and 96 based on the notified filling state. A specific control method of the control portion 104 will be described in detail in a liquid filling method described later with reference to FIGS. 1B to 1H. The control portion 104 reads a program stored in a storage device such as a read only memory (ROM) and a random access memory (RAM) (not illustrated) as an example and executes a series of operations from FIGS. 1B to 1H.

In FIG. 2, the third detection portion 103 may not be provided for the reason described below. The first reason is that, for example, even when air bubbles remain in the liquid flow path 8, the air bubbles eventually move to the first tank 3 side. The second reason is that even when the liquid supply from the second tank 2 to the first tank 3 is interrupted due to the use of the ink jet recording apparatus 110, the remaining amount of the liquid 12 can be detected and the ejection failure can be avoided by providing the filling amount detection material 13 in the first tank 3. Therefore, it is sufficient that the user who performs the filling work without providing the third detection portion 103 visually confirms whether or not the liquid flow path 8 is filled with the liquid 12.

In addition, FIG. 1A describes the shape of the head tank 3 by exemplifying a simple shape suitable for versatility and mass productivity. However, in order to optimize the performance of the ink jet recording apparatus 110 mounted with the liquid storage device 100, the head tank 3 may have a complicated shape in consideration of the flow path resistance of the liquid 12. Furthermore, the switching control of one of the open state and the closed state of the valves 92, 93 and 96 and the filling control of the liquid 12 may be performed manually by the user, in addition to a method using the control signal output from the control portion 104 (FIG. 2).

First Embodiment

Next, the liquid filling method of the first embodiment will be described again with reference to FIGS. 1A to 1H. FIGS. 1B to 1H are diagrams describing steps of filling the supply tank 2 and the head tank 3 which are not filled with the liquid with the liquid. FIG. 1A illustrates a state before filling the supply tank 2 and the head tank 3 with the liquid. The first and second liquid introduction ports 4 and 5 are in the closed state by the valves 93 and 92 and the atmospheric communication port 6 is in a non-communication state by the valve 96.

Figure 1B:
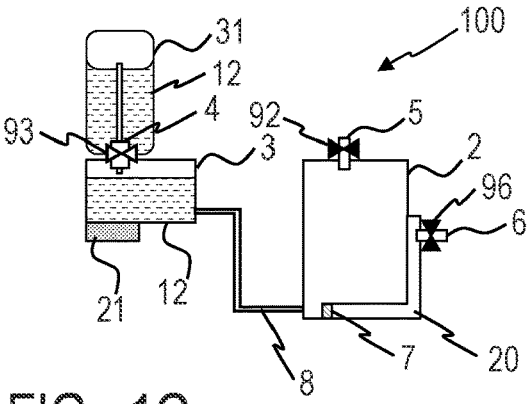
Figure 2:
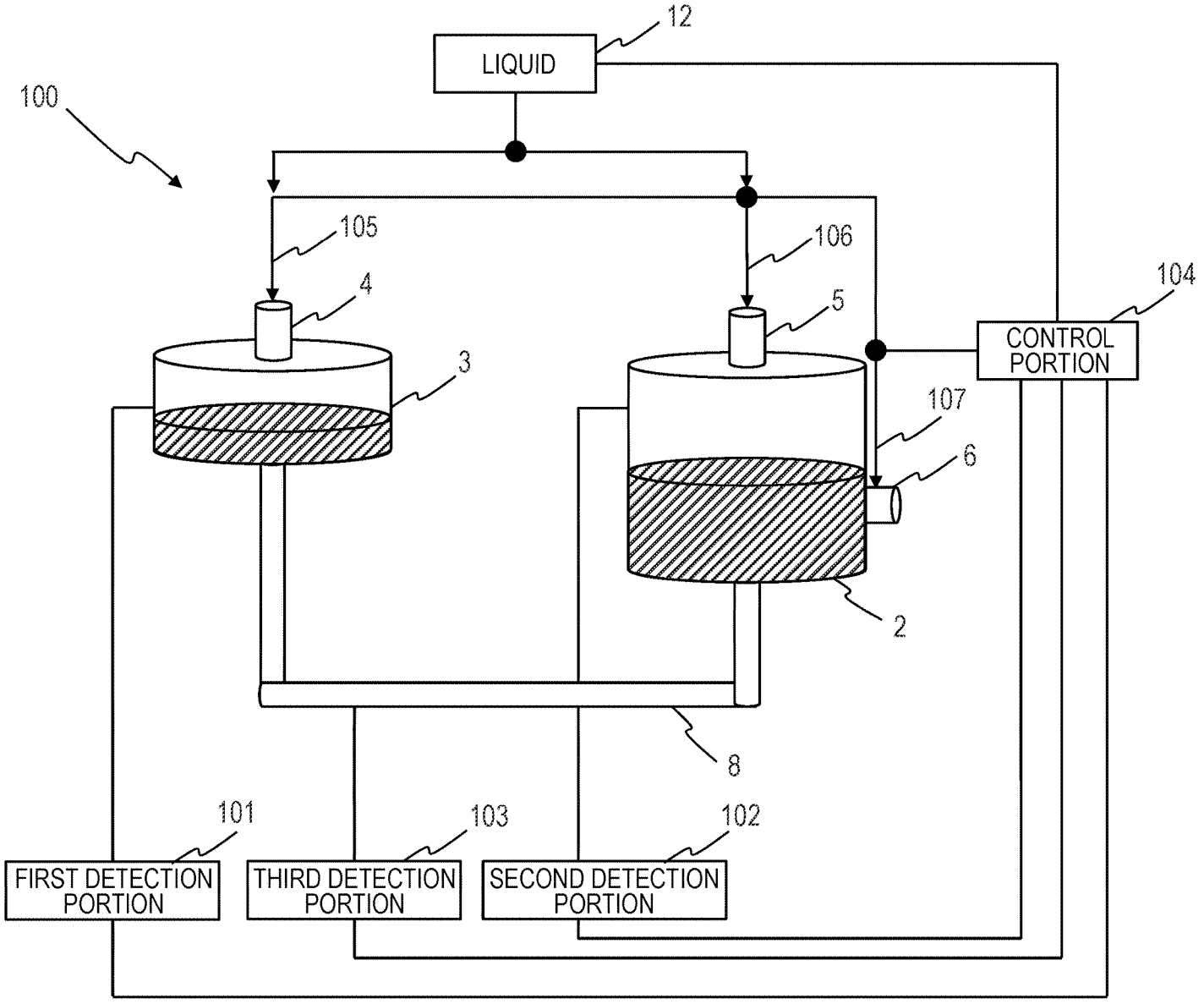
FIG. 2 is a block diagram describing an outline of a configuration of a liquid storage device.

Next, in the step of FIG. 1B, the valve 93 of the first liquid introduction port 4 is opened. The first liquid introduction port 4 is in the open state, the second liquid introduction port 5 is in the closed state and the atmospheric communication port 6 is in the non-communication state. In this state, a tip end of a bottle 31 (liquid storage container) filled with the liquid 12 is inserted into the first liquid introduction port 4 to inject the liquid 12 into the inside of the head tank 3. Although not illustrated, the bottle 31 has a liquid injection portion and a gas discharge portion so that the air inside the head tank 3 can be replaced with the injected liquid 12. At this time, since the second liquid introduction port 5 is in the closed state and the atmospheric communication port 6 is in the non-communication state, the liquid hardly flows into the tube 8 and the supply tank 2. Therefore, the liquid 12 injected from the bottle 31 accumulates inside the head tank 3 and the air inside the head tank 3 moves to the inside of the bottle 31. The inside of the head tank 3 is filled with the liquid 12 by performing such gas-liquid exchange supply in which the gas and the liquid are exchanged through the first liquid introduction port 4. By enabling the liquid 12 to directly inject into the head tank 3 in this manner, it is possible to create a state where a gas other than the gas dissolved in the liquid 12 hardly enters the inside of the head tank 3. In other words, since it is not necessary to fill the head tank 3 with the liquid 12 from the supply tank 2 through the liquid flow path 8, the possibility that air existing in the supply tank 2 and the liquid flow path 8 flows into the head tank 3 is reduced.

Figure 1C:
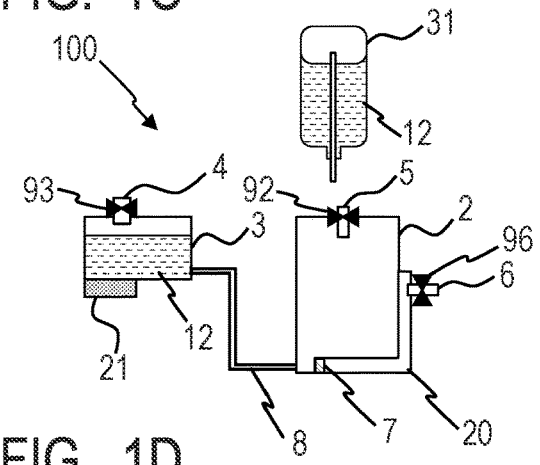
Figure 1D:
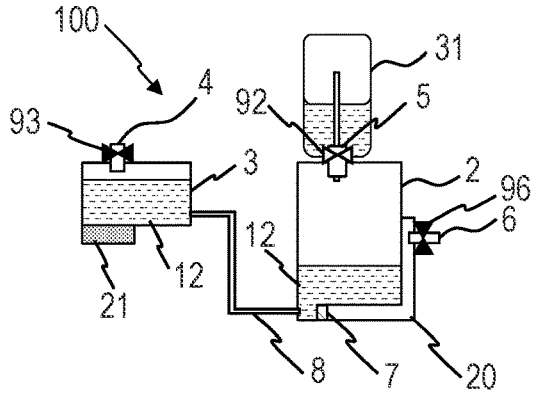

Next, in a step of FIG. 1C, after filling the inside of the head tank 3 with a predetermined amount of the liquid 12, the tip end of the bottle 31 is pulled out from the first liquid introduction port 4, the valve 93 of the first liquid introduction port 4 is closed and the first liquid introduction port 4 is in the closed state. Next, in a step of FIG. 1D, the valve 92 of the second liquid introduction port 5 is opened to allow the second liquid introduction port 5 to be in the open state. In this state, the tip end of the bottle 31 filled with the liquid 12 is inserted into the second liquid introduction port 5 to inject the liquid 12 into the inside of the supply tank 2. The liquid injection portion and the gas discharge portion of the bottle 31 replace the air inside the supply tank 2 with the injected liquid. At this time, the first liquid introduction port 4 is in the closed state and the atmospheric communication port 6 is in the non-communication state. Since the ejection orifice for ejecting the liquid 12 is opening in the recording element portion 21 provided on the bottom surface of the head tank 3, strictly speaking, although the head tank 3 is not a closed space, since the ejection orifice has a high flow resistance, the head tank 3 can be regarded as a closed space. In order to further improve the airtightness of the head tank 3, the recording element portion 21 may be sealed with a rubber member. Therefore, the liquid hardly flows into the tube 8 and the liquid hardly flows from the supply tank 2 into the head tank 3. As a result, the liquid 12 injected from the bottle 31 is accumulated only inside the supply tank 2 and the air inside the supply tank 2 moves to the inside of the bottle 31. The inside of the supply tank 2 is filled with the liquid 12 by performing such gas-liquid exchange supply in which the gas and the liquid are exchanged through the second liquid introduction port 5. By enabling the liquid 12 to directly inject into the supply tank 2 in this manner, it is possible to create a state where a gas other than the gas dissolved in the liquid 12 hardly enters the inside of the supply tank 2. That is, since the liquid 12 does not move through the tube 8, air bubbles are unlikely to accumulate in the head tank 3.

Figure 1E:
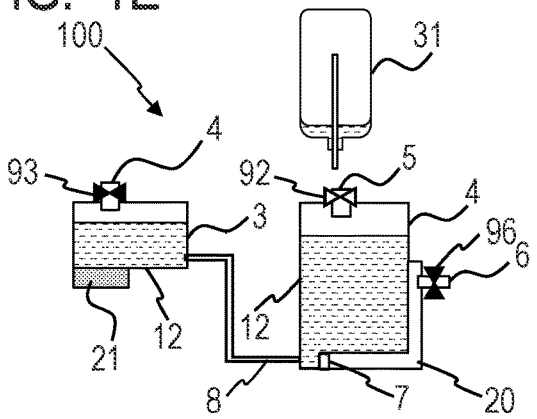
Figure 1F:
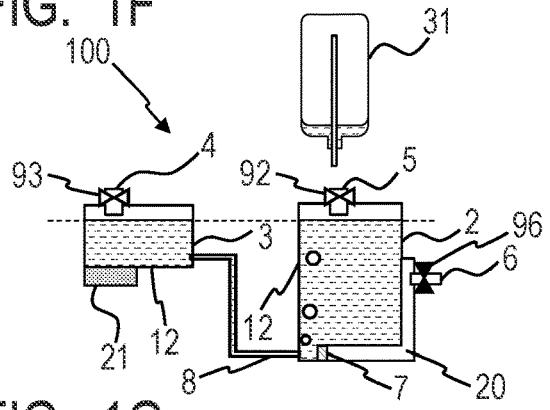

Next, in a step of FIG. 1E, after filling the inside of the supply tank 2 with a predetermined amount of the liquid 12, the tip end of the bottle 31 is pulled out from the second liquid introduction port 5. Next, in a step of FIG. 1F, the valve 93 of the first liquid introduction port 4 is opened to allow the first liquid introduction port 4 to be in the open state. As a result, atmospheric pressure is applied to the liquid level of the liquid 12 filled in the head tank 3 and the liquid level of the liquid 12 filled in the supply tank 2. In an example of FIG. 1E, since the liquid level of the liquid 12 of the head tank 3 is higher than the liquid level of the liquid 12 of the supply tank 2, the liquid 12 of the head tank 3 flows into the supply tank 2 through the tube 8. At this time, the gas inside the tube 8 is pushed out to the supply tank 2 and replaced with the liquid 12. FIG. 1F illustrates a state where the height of the liquid level inside the head tank 3 and the height of the liquid level inside the supply tank 2 are uniform and the heights of the liquid levels may not be uniform depending on the design of the pressure loss of the head tank 3, the supply tank 2 and the tube 8. In the present embodiment, the liquid 12 may flow into the inside of the tube 8.

Figure 1G:
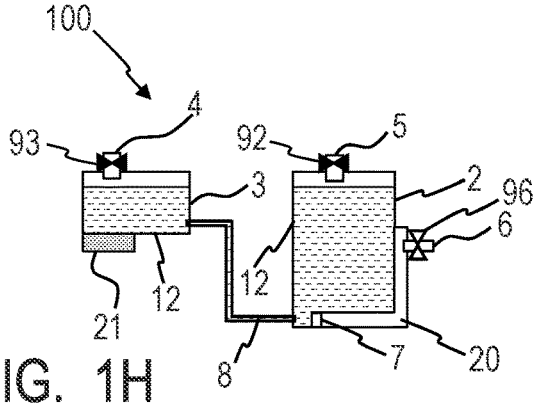
Figure 1H:
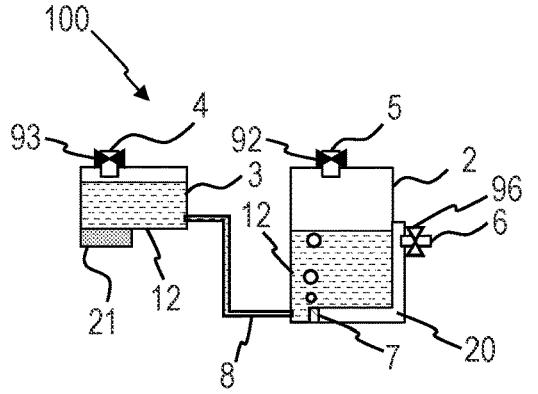

Next, in a step of FIG. 1G, after filling inside the tube 8 with the liquid 12, the valves 93 and 92 of the first and second liquid introduction ports 4 and 5 are closed and the first and second liquid introduction ports 4 and 5 are in the closed state. The valve 96 of the atmospheric communication port 6 is opened and the atmospheric communication port 6 is in a communication state. As a result, the filling of the liquid 12 into the liquid storage device 100 is completed. The liquid 12 inside the head tank 3 is consumed by the ink jet recording apparatus 110 mounted with the liquid storage device 100 ejecting the liquid 12 from the ejection orifice and recording the liquid 12 on the recording medium. Therefore, as illustrated in FIG. 1H, air corresponding to the volume of the consumed liquid 12 is supplied to the supply tank 2 from the atmospheric communication port 6 through the slit wall 7 and accumulates on the upper portion of the supply tank 2. The liquid 12 inside the supply tank 2 is pressed by the air accumulated on the upper portion of the supply tank 2 and the liquid 12 is supplied to the inside of the head tank 3 through the tube 8. As a result, the hydraulic head differential pressure between the head tank 3 and the supply tank 2 can be kept constant.

As described above, in the present embodiment, when the tank is filled with the liquid 12, a tank other than the tank filled with the liquid 12 is closed and the liquid 12 can be directly injected into each tank. As a result, the gas hardly enters the inside of the tank filled with the liquid and the generation of accumulated air bubbles inside the tank can be suppressed. Therefore, according to the present embodiment, it is not necessary to provide a mechanism such as a negative pressure generating device in advance, so that the cost of the ink jet recording apparatus can be reduced.

Modification Example

A liquid filling method of a modification example will be described with reference to FIGS. 3A to 3E. FIGS. 3A to 3E are diagrams describing steps of filling the supply tank 2 and the head tank 3 with the liquid after the liquid 12 inside the head tank 3 is consumed. Since it is basically the same as each step of the first embodiment, the differences will be mainly described below.

Figure 3A:
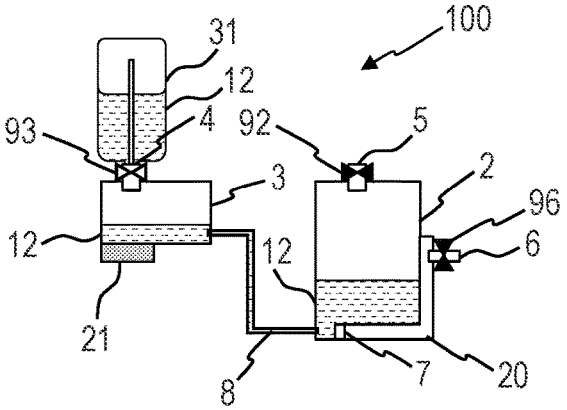
FIGS. 3A, 3B, 3C, 3D and 3E are diagrams describing steps of a modification example of filling a tank using a predetermined amount of liquid with the liquid.

As described in the first embodiment, the step of filling the supply tank 2 with the liquid after the liquid 12 inside the head tank 3 is further consumed through the step of FIG. 1H is a step of FIG. 3A. Therefore, the step of FIG. 3A is substantially the same as the step of FIG. 1B of the first embodiment. In addition, a step of FIG. 3B is a step of pulling out the tip end of the bottle 31 from the first liquid introduction port 4 and closing the first liquid introduction port 4 when the inside of the head tank 3 is filled with a predetermined amount of the liquid 12. Therefore, the step of FIG. 3B is substantially the same as the step of FIG. 1C. Furthermore, a step of FIG. 3C is a step of opening the second liquid introduction port 5 and inserting the tip end of the bottle 31 filled with liquid 12 into the second liquid introduction port 5 to inject the liquid 12 into the inside of the supply tank 2. At this time, since the first liquid introduction port 4 is in the closed state and the atmospheric communication port 6 is in the non-communication state, the step of FIG. 3C is substantially the same as the step of FIG. 1D.

Figure 3D:
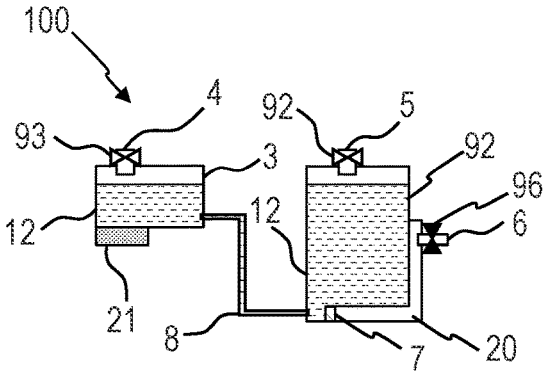
Figure 3B:
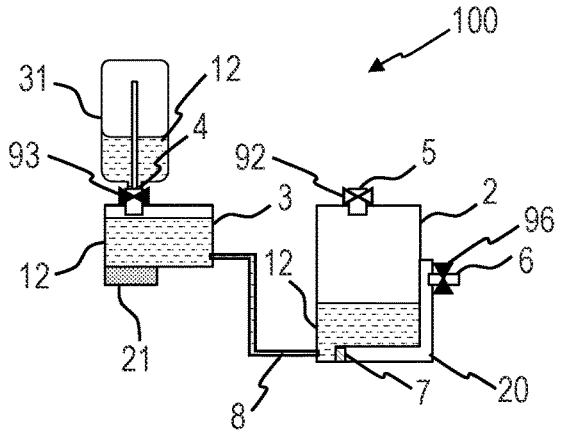
Figure 3E:
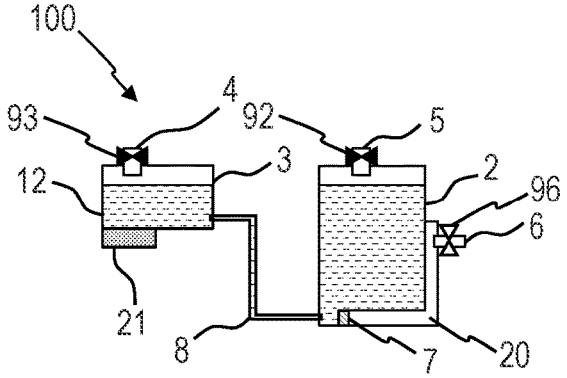
Figure 3C:
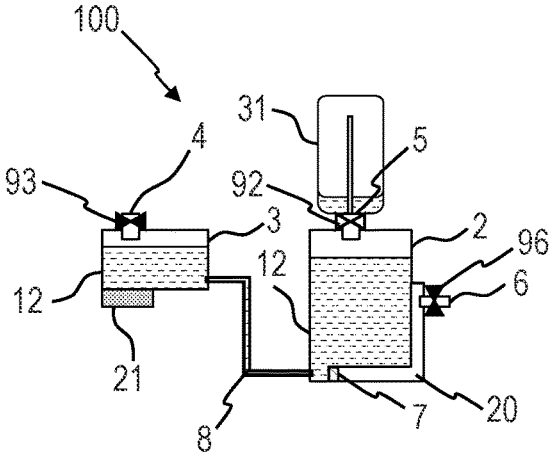

In a step of FIG. 3D, the first liquid introduction port 4 is opened and atmospheric pressure is applied to the surface of the liquid 12 filled in the head tank 3 and the surface of the liquid 12 filled in the supply tank 2 to flow the liquid 12 filled in the head tank 3 or the supply tank 2 into the tube 8. That is, by opening the first liquid introduction port 4 while keeping the second liquid introduction port 5 open and filling the tube 8 with the liquid 12, the gas inside the tube 8 is pushed to the outside of the liquid 12. Therefore, the step of FIG. 3D is substantially the same as the step of FIG. 1F. In addition, in a step of FIG. 3E, when the inside of the tube 8 is filled with the liquid 12, the first and second liquid introduction ports 4 and 5 are in the closed state and the atmospheric communication port 6 is in a communication state. Therefore, the step of FIG. 3E is substantially the same as the step of FIG. 1G. As a result, the filling of the liquid storage device 100 is completed.

In this modification example, in the maintenance work of filling the liquid 12 that always occurs during the use of the ink jet recording apparatus 110, when the tank is filled with the liquid 12, a tank other than the tank filled with the liquid 12 is in a closed space. In addition, when the tank is filled with the liquid 12, the liquid 12 can be directly injected into each tank. As a result, the gas hardly enters the inside of the tank and the generation of air bubbles inside the tank can be suppressed. Therefore, according to the present embodiment, it is not necessary to provide a mechanism such as a negative pressure generating device in advance, so that the cost of the ink jet recording apparatus can be reduced.

Other Embodiments

Figure 4A:
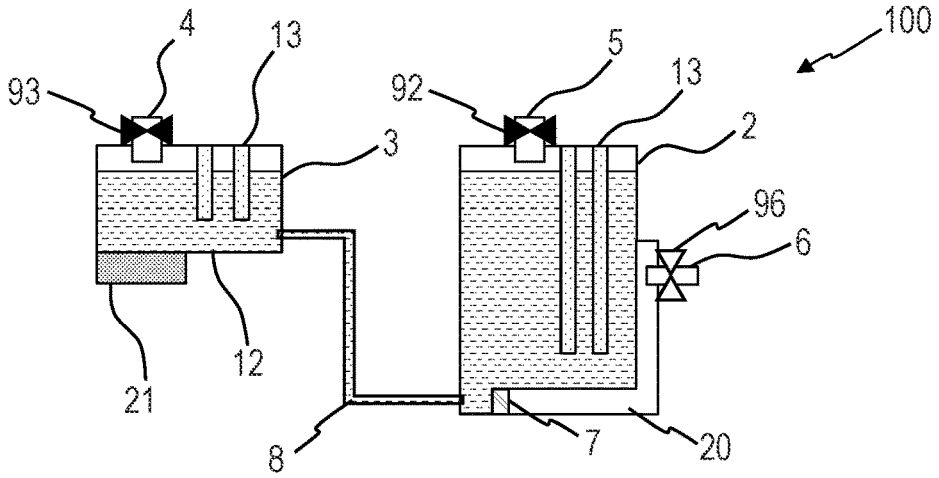
FIGS. 4A, 4B and 4C are diagrams describing a method of detecting a filling amount of the liquid of another embodiment.
Figure 4B:
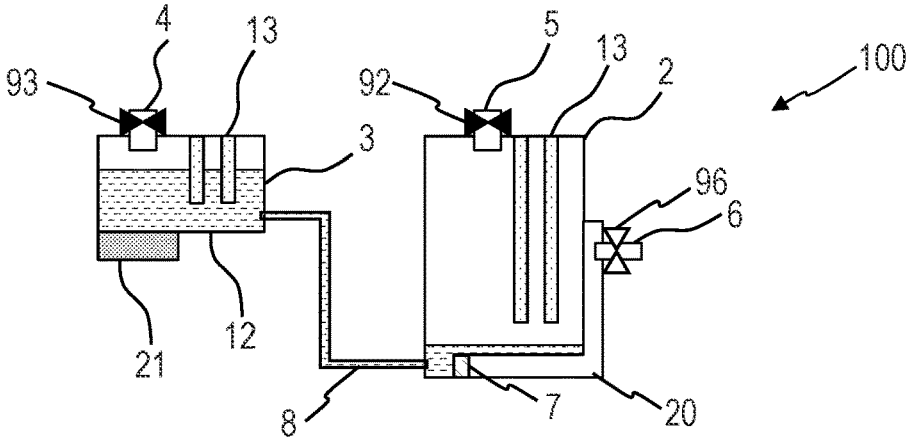
Figure 4C:
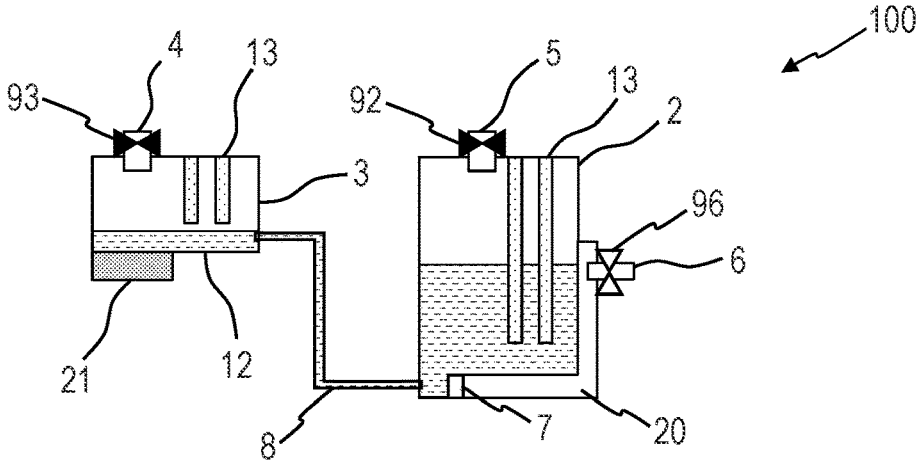

Next, a method of detecting a filling amount of a liquid of another embodiment will be described with reference to FIGS. 4A to 4C. As illustrated in FIGS. 4A to 4C, two filling amount detection materials 13 for detecting the filling amount of the liquid 12 are provided inside each of the head tank 3 and the supply tank 2 constituting the liquid storage device 100. FIG. 4A illustrates a state where the head tank 3 and the supply tank 2 are sufficiently filled with the liquid 12. In this case, the filling amount detection material 13 detects that the filling amount of the liquid 12 inside both tanks is sufficient. FIG. 4B illustrates a state where the filling amount of the liquid 12 inside the supply tank 2 is extremely small as compared with the filling amount of the liquid 12 inside the head tank 3. In this case, the filling amount detection material 13 of the supply tank 2 detects that the filling amount of the liquid 12 inside the supply tank 2 is small. FIG. 4C illustrates a state where the filling amount of the liquid 12 inside the head tank 3 is extremely small as compared with the filling amount of the liquid 12 inside the supply tank 2. In this case, the filling amount detection material 13 of the head tank 3 detects that the filling amount of the liquid 12 inside the head tank 3 is small.

Both the liquid 12 and the filling amount detection material 13 have conductivity. Therefore, when a predetermined voltage is applied between the two filling amount detection materials 13 in a state of being in contact with the liquid 12, a predetermined current flows between the two filling amount detection materials 13. In a state where the two filling amount detection materials 13 are not in contact with the liquid 12, no current flows between the two filling amount detection materials 13. By utilizing this characteristic, it is possible to grasp the filling amount of the liquid 12 inside the tank.

In FIGS. 4A to 4C, a rod-shaped member is taken as an example as the filling amount detection material 13 and the description is not limited thereto. For example, any method may be used as long as the filling amount of the liquid 12 inside the tank can be detected, such as using an electrode pad as the filling amount detection material 13 and forming a tank with a material whose internal filling amount can be visually recognized from the outside. In addition, it is also possible to measure the amount of air bubbles accumulated inside the head tank 3 and the supply tank 2 within a predetermined time in advance and detect the filling amount of the liquid 12 inside the tank based on the amount of air bubbles accumulated inside the tank, without providing the filling amount detection material 13. Furthermore, it is also possible to predict the filling amount of the liquid 12 inside the tank by counting the total number of times the liquid 12 is ejected from the ejection orifice by the ejection energy generated by the recording element portion 21.

In FIGS. 4A to 4C, an example in which the filling amount detection material 13 is provided in the head tank 3 and the supply tank 2 is described. This is to more accurately grasp the tank that needs to be filled with the liquid 12 and the timing of filling. As a result, it is possible to omit unnecessary filling work of the liquid 12.

Normally, in a case where the ink jet recording apparatus 110 is used, it is known that air bubbles are likely to accumulate in the supply tank 2 provided with the slit wall 7. Therefore, as illustrated in FIG. 4B, the filling amount of the liquid 12 in the supply tank 2 may be extremely small as compared with the filling amount of the liquid 12 in the head tank 3. At this time, for example, in a case where the filling amount detection material 13 is provided only in the supply tank 2, the opportunity to fill the supply tank 2 with the liquid 12 can be reliably captured based on the filling amount of the liquid 12 detected by the filling amount detection material 13. However, since the head tank 3 is not provided with the filling amount detection material 13, for example, in a case where the filling amount of the liquid 12 in the head tank 3 is extremely small as illustrated in FIG. 4C, the filling amount of the liquid 12 in the head tank 3 cannot be captured and an ejection failure may occur. On the other hand, the tube 8 is damaged, the valve 93 of the first liquid introduction port 4 is damaged, air bubbles are accumulated inside the head tank 3 and the filling amount of the liquid 12 in the head tank 3 may be extremely reduced as illustrated in FIG. 4C. In this case, when the head tank 3 is provided with the filling amount detection material 13, the filling amount of the liquid 12 can be captured, so that it is possible to avoid the ejection failure.

In a case where the filling amount detection material 13 is provided in either the head tank 3 or the supply tank 2, the filling amount of the liquid 12 in one tank can be detected, but the filling amount of the liquid 12 in another tank cannot be detected. For example, in a case where the material of the head tank 3 is resin, air bubbles trapped in a significantly small gap on the resin surface may be separated. Such air bubbles are often generated at the time when the use of the ink jet recording apparatus 110 is started and tend to be hardly separated after a long period of use. Therefore, it is desirable to provide the filling amount detection material 13 in both the head tank 3 and the supply tank 2 to capture the filling amount of the liquid 12 in the tank and promote the filling of the liquid 12 at an appropriate timing.

In the present embodiment, in the maintenance work of filling the head tank 3 with the liquid 12 which is generated periodically, the liquid 12 can be directly injected into the inside of the tank. As a result, it is possible to create a state where the gas hardly enters the inside of the head tank 3. In addition, the generation of air bubbles accumulated inside the head tank 3 can be easily suppressed. However, it is not efficient to fill a tank having a large filling amount of liquid 12 with the liquid 12. This is because filling the liquid 12 increases the chances of injecting the gas dissolved in the liquid 12 into the tank. Therefore, it is important to provide the filling amount detection material 13 in the head tank 3 and the supply tank 2 and accurately grasp the filling amount of the liquid 12 filled in each tank. As a result, it is possible to easily prevent the generation of air bubbles accumulated inside the head tank by the minimum necessary filling work.

In each of the above embodiments, a valve is taken as an example for description as a unit for opening and closing the liquid introduction port of each tank. However, as long as the liquid introduction port can be opened and closed, a unit other than the valve (for example, cap and stopper) may be used.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-218692, filed Dec. 3, 2019, which is hereby incorporated by reference herein in its entirety.

What is claimed is:

1. A liquid filling method of filling a liquid storage device including a first tank that stores a liquid to be supplied to an ejection head ejecting the liquid and a second tank that stores the liquid to be supplied to the first tank through a connection port provided in the first tank with the liquid, wherein the first tank includes a first valve that opens or closes the first liquid introduction port and the second tank includes a second valve that opens or closes the second liquid introduction port, the method comprising:

injecting the liquid from a liquid storage container into the first tank through a first liquid introduction port provided in the first tank, in a state where a second liquid introduction port provided in the second tank is closed;

opening the first liquid introduction port by the first valve when injecting the liquid into the first tank;

closing the second liquid introduction port by the second valve when the first liquid introduction port is opened;

opening the first liquid introduction port by the first valve and closing the second liquid introduction port by the second valve, when the liquid is injected into the first tank through the first liquid introduction port; and closing the first liquid introduction port by the first valve and opening the second liquid introduction port by the second valve, when the liquid is injected into the second tank through the second liquid introduction port.

2. The liquid filling method according to claim 1, further comprising:

flowing the liquid into a liquid flow path that connects the first tank and the second tank, when the first tank and the second tank are filled with a predetermined amount of the liquid, the first valve opens the first liquid introduction port, and the second valve opens the second liquid introduction port.

3. The liquid filling method according to claim 1, wherein the second tank further includes a third valve that opens or closes an atmospheric communication port allowing an inside of the second tank to communicate with an atmosphere, the method further comprises:

closing the atmospheric communication port by the third valve before injecting the liquid into the first tank; and opening the atmospheric communication port by the third valve after injecting the liquid into the second tank.

4. The liquid filling method according to claim 1, further comprising:

detecting a filling amount of the liquid in at least one of the first tank and the second tank.

5. A liquid storage device comprising:

a first tank that stores a liquid to be supplied to an ejection head ejecting the liquid;

a second tank that stores the liquid to be supplied to the first tank through a connection port provided in the first tank; and a first liquid introduction port provided in the first tank and allowing direct injection of the liquid into the first tank, wherein the first tank includes a first valve that opens the first liquid introduction port when directly injecting the liquid into the first tank, wherein the second tank is sealable when the first liquid introduction port is opened, and wherein the second tank includes a second liquid introduction port being sealable when the first liquid introduction port is opened, and wherein the first valve opens the first liquid introduction port and the second valve closes the second liquid introduction port, when directly injecting the liquid into the first tank, and the first valve closes the first liquid introduction port and the second valve opens the second liquid introduction port, when directly injecting the liquid into the second tank.

6. The liquid storage device according to claim 5, wherein the second tank is sealable when the first liquid introduction port is opened.

7. The liquid storage device according to claim 5, further comprising:

a filling amount detection material that detects a filling amount of the liquid in at least one of the first tank and the second tank.

8. The liquid storage device according to claim 5, wherein the second tank further includes an atmospheric communication port that allows an inside of the second tank to communicate with an atmosphere and a third valve that opens or closes the atmospheric communication port, and a wall that forms a boundary surface between the inside of the second tank and the atmosphere and allows gas to pass through and does not allow the liquid to pass through is provided on a bottom surface of the second tank.

9. The liquid storage device according to claim 8, wherein an air flow path is provided between the wall and the atmospheric communication port.

10. A liquid filling method of filling a liquid storage device including a first tank that stores a liquid to be supplied to an ejection head ejecting the liquid and a second tank that stores the liquid to be supplied to the first tank through a connection port provided in the first tank with the liquid, the method comprising:

injecting the liquid from a liquid storage container into the first tank through a first liquid introduction port provided in the first tank, in a state where a second liquid introduction port provided in the second tank is closed; and detecting a filling amount of the liquid in both the first tank and the second tank.

11. A liquid storage device comprising:

a first tank that stores a liquid to be supplied to an ejection head ejecting the liquid;

a second tank that stores the liquid to be supplied to the first tank through a connection port provided in the first tank;

a first liquid introduction port provided in the first tank and allowing direct injection of the liquid into the first tank; and a filling amount detection material that detects a filling amount of the liquid in both the first tank and the second tank.

* * * * *